US006682186B2

(12) United States Patent
Smith et al.

(10) Patent No.: US 6,682,186 B2
(45) Date of Patent: Jan. 27, 2004

(54) GRADED CAPILLARITY STRUCTURES FOR PASSIVE GAS MANAGEMENT, AND METHODS

(75) Inventors: Gilbert G. Smith, Corvllis, OR (US); Jeffery S. Hess, Corvallis, OR (US)

(73) Assignee: Hewlett-Packard Development Company, LP., Houston, TX (US)

( * ) Notice: Subject to any disclaimer, the term of this patent is extended or adjusted under 35 U.S.C. 154(b) by 0 days.

(21) Appl. No.: 10/123,620

(22) Filed: Apr. 15, 2002

(65) Prior Publication Data

US 2002/0186283 A1 Dec. 12, 2002

Related U.S. Application Data

(63) Continuation-in-part of application No. 09/877,960, filed on Jun. 8, 2001.

(51) Int. Cl.[7] ..... B41J 2/19; B41J 2/05

(52) U.S. Cl. ..... 347/92; 347/67

(58) Field of Search ..... 347/63, 65, 67, 347/85, 86, 92

(56) References Cited

U.S. PATENT DOCUMENTS

| | | | | |
|---|---|---|---|---|
| 4,771,295 A | | 9/1988 | Baker et al. | 347/87 |
| 4,999,652 A | | 3/1991 | Chan | 347/86 |
| 5,500,270 A | | 3/1996 | Langdon et al. | 428/119 |
| 5,728,446 A | | 3/1998 | Johnston et al. | 428/167 |
| 6,003,986 A | | 12/1999 | Keefe | 347/92 |
| 6,084,616 A | * | 7/2000 | Nakata et al. | 347/65 |
| 6,176,573 B1 | | 1/2001 | Barth et al. | 347/92 |

FOREIGN PATENT DOCUMENTS

| | | | |
|---|---|---|---|
| EP | 0709210 A1 | 5/1996 | B41J/2/175 |

* cited by examiner

*Primary Examiner*—Juanita Stephens
(74) *Attorney, Agent, or Firm*—Larry Baker

(57) ABSTRACT

Embodiments of the present invention comprise capillary fluid transport and containment structures in which a capillarity gradient is provided in a direction other than the primary direction of fluid transport to selectively capture and transport gas bubbles. The structures may be formed with single capillary members or may include a plurality of capillaries, such as sheet capillaries joined by appropriately sized through-holes.

29 Claims, 7 Drawing Sheets

GRADED CAPILLARITY STRUCTURES FOR PASSIVE GAS MANAGEMENT, AND METHODS

RELATED APPLICATION

This application is a continuation-in-part of U.S. patent application Ser. No. 09/877,960, filed Jun. 8, 2001 "Graded Capillarity Structures for Passive Gas Management, And Methods", assigned to assignee of the present application.

TECHNICAL FIELD OF THE INVENTION

The present invention relates generally to devices and methods for managing gas in a liquid distribution system, and more particularly to the control of gas bubbles within a capillary fluid transport and containment system.

BACKGROUND OF THE INVENTION

In many applications requiring the movement or containment of fluids, the formation of bubbles of gas within the fluid can adversely affect system performance. For example, gas bubbles in the ink delivery system of an inkjet printer can degrade print quality or lead to printhead failure.

Fluids exposed to the atmosphere typically contain dissolved gases in amounts varying with the temperature. The amount of gas that a liquid can hold depends on temperature and pressure, but also depends on the extent of mixing between the gas and liquid and the opportunities the gas has had to escape. Changes in atmospheric pressure normally can be neglected since ambient atmospheric pressure stays fairly constant. However, temperature variations typically have a significant impact on the amount of gas a fluid may hold.

Most fluids exposed to the atmosphere contain dissolved gases in amounts proportional to the temperature of the fluid itself. The colder the fluid, the greater the capacity to absorb gases. If a fluid saturated with gas is heated, the dissolved gases are no longer in equilibrium and tend to diffuse out of solution. If nucleation seed sites are present along the surface containing the fluid or within the fluid, bubbles will form, and as the fluid temperature rises further, these bubbles grow larger.

Bubbles are not only composed of air, but may also include other constituents from the fluid. In an inkjet printer, for example, these include water vapor and vapors from other ink-vehicle constituents. However, the behavior of all liquids are similar, and the hotter the liquid becomes, the less gas it can hold. Both gas release and vapor generation cause bubbles to start and grow as temperature rises.

The conditions most conducive to bubble generation are the simultaneous presence of (1) generating or "seed" sites, (2) fluid flow and (3) bubble accumulators. These three mechanisms work together to produce large bubbles that can clog and stop flow in fluid delivery systems. When air comes back out of solution as bubbles, it does so at preferential locations, or generation or nucleation sites. Bubbles like to start at edges and corners or at surface scratches, roughness, or imperfections. Very small bubbles tend to stick to the surfaces and resist floating or being swept along in a current of fluid. When the bubbles get larger, they are more apt to break loose and move along. However, if the bubbles form in a corner or other out-of-the-way location, it is almost impossible to dislodge them by fluid currents.

While bubbles may not start at gas generating sites when the fluid is not flowing past those sites, when the fluid is moving, the bubble generation site is exposed to a much larger volume of fluid containing dissolved gas molecules. As fluid flows past the gas generating site, gas molecules can be brought out of solution to form and grow a bubble.

The third contributor to bubble generation is the accumulator or bubble trap, which can be defined as any expansion and subsequent narrowing along an fluid passage. This configuration amounts to a chamber in the fluid flow path with an entrance and an exit. The average fluid flow rate, in terms of volume of fluid per cross section of area per second, is smaller within the chamber than at the entrance or at the exit. The entrance edge of the chamber may act as a gas generating site because of its sharpness and because of the discontinuity of fluid flow over the edge. Bubbles will be generated at this site, and when they become large enough they get moved along toward the exit duct until the exit duct is blocked. Then, unless the system can generate enough pressure to push the bubble through, the fluid delivery system will become clogged and fluid delivery will be impeded.

In the field of inkjet printing, for example, there is a need to prevent air bubbles from reaching or accumulating in the inkjet printhead. Air bubble accumulation is a particular worry near a thermal inkjet printhead, which typically comprises a silicon chip containing an array of heating resistors which boil ink and expel it, through an array of orifices adjacent to the resistors and onto nearby print media. The presence of air bubbles in the printhead can seriously degrade print quality, can shorten the usable life of a printhead, and, if air accumulation results in "dry firing" of the printhead, can cause catastrophic failure of the printhead. This problem has typically been addressed by either "warehousing" air away from the printhead, or providing active ink recirculation through the printhead to move bubbles out of the printhead.

Air "warehousing" is typically used with replaceable ink cartridges where the printhead is replaced along with the ink supply (see, for example, U.S. Pat. No. 4,931,811 to Cowger et al., THERMAL INK JET PEN HAVING A FEEDTUBE WITH IMPROVED SIZING AND OPERATIONAL WITH A MINIMUM OF DEPRIMING, assigned to the assignee of the present invention). A gas accumulator is provided near the printhead nozzle plate for accumulating gas bubbles. Once the volume of gas exceeds the volume of the gas accumulator, the printhead will typically fail. Air warehousing thus necessitates increasing the size of the printhead to accommodate the gas accumulator, and is not generally suitable for long-life or permanent printheads.

Ink recirculation involves moving ink through a printhead to actively carry bubbles away from printhead. Typically used with long-life or permanent printheads, ink recirculation requires that a return path be provided from the printhead to the ink reservoir, with the attendent check valves, pumping system, and pressure regulators. Since a printer may include four or more ink colors, ink recirculation greatly increases the complexity of a printer.

The use of capillary materials in fluid containment and transport systems is well known. In the field of inkjet printing, for example, capillary foam materials are often used in ink cartridges, where the capillary strength (also referred to as capillary affinity or capillarity) of the foam can be used to provide a negative backpressure to prevent drooling of the printhead (see, for example, Baker, U.S. Pat. No. 4,771,295, THERMAL INK JET PEN BODY CONSTRUCTION HAVING IMPROVED INK STORAGE AND FEED CAPABILITY, assigned to the assignee of the present invention).

It is also known in the art to grossly vary the capillarity within a fluid system to selectively attract fluid to a region. For example, the capillarity of a porous foam ink storage member may be locally varied by compressing the foam to insure that the foam immediately adjacent to the printhead remains saturated as the cartridge is depleted (Baker, U.S. Pat. No. 4,771,295, THERMAL INK JET PEN BODY CONSTRUCTION HAVING IMPROVED INK STORAGE AND FEED CAPABILITY, assigned to the assignee of the present invention). Alternatively, the foam may be selectively compressed at the top of an ink chamber to compensate for the gravity head due to the column of ink when the pen is full (Altendorf, EP0709210, INK-JET PEN WITH CAPILLARITY GRADIENT, and related U.S. application Ser. No. 08/813715, both assigned to the assignee of the present invention).

The foams utilized in such applications, however, allow only a coarse gradation of average capillarity. When examined in detail, the fine capillary structures of such foams vary randomly over a significant range of capillary sizes, resulting in local areas within the foam where gas bubbles may become lodged. In essence, local areas of capillary widening within the foam act as minute bubble traps. Absent the application of high pressure fluid to the foam (such as may be utilized in the initial production of the pens), the volume of such foams occupied by gas increases over time, and the flow of fluid is increasingly impeded.

Similar gas management concerns exist in other fields. In fuel cells, for example, gas bubbles may be generated within the cell as the result of the chemical reaction of the reactants. Provisions must be made in the design of a fuel cell to remove these bubbles from the cell and to prevent their clogging the fluid transport paths.

There is therefore a need for passive gas management devices and methods which achieve gas management without the expense and complexity of active fluid recirculation systems.

SUMMARY OF THE INVENTION

Embodiments of the present invention comprise capillary fluid transport and containment structures in which a capillarity gradient is provided in a direction other than the primary direction of fluid transport to selectively capture and transport gas bubbles.

Other aspects and advantages of the present invention will become apparent from the following detailed description, taken in conjunction with the accompanying drawings, illustrating by way of example the principles of the invention.

DESCRIPTION OF THE PREFERRED EMBODIMENT

Figure 1:
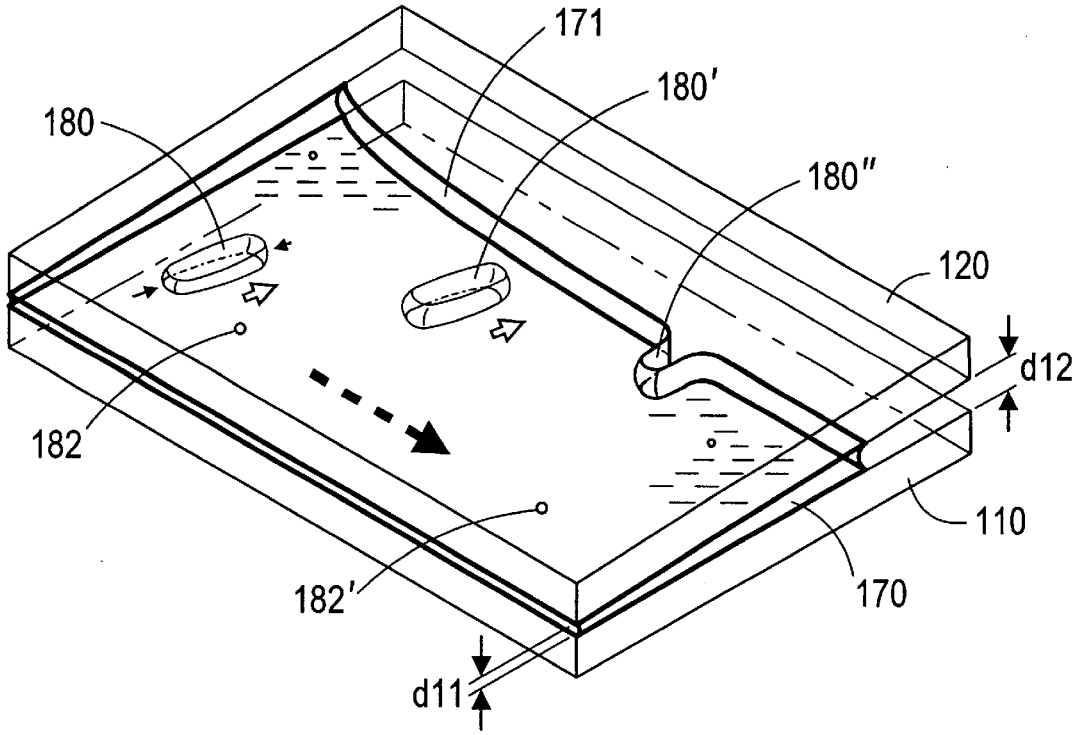
FIG. 1 is an isometric view of a plate capillary structure illustrating an embodiment of the physical mechanisms utilized by the present invention.

FIG. 1 depicts a simple embodiment of the present invention. In FIG. 1, a capillary for fluid transport is formed between two flat plates 110, 120. As indicated by the heavy dashed arrow, fluid 170 flows between the plates from a fluid source (not shown) at the upper left to a fluid sink (not shown) at the lower right. A capillary gradient is formed in a direction substantially orthogonal to the direction of fluid flow by varying the separation of the plates from a distance d11 at the lower left to a distance d12 at the upper left. The fluid 170 fills the capillary space to a level determined by pressures within the fluid, forming a meniscus 171 at the outer edge of the fluid.

As shown at 180 in FIG. 1, a gas bubble which has reached a sufficient volume such that it contacts the upper and lower plates 110, 120 of the capillary is subjected to varying capillary forces, as indicated by the varying-length small solid arrows. The surface tension at the fluid/gas interface of the bubble acts as a stretched elastic membrane, seeking to minimize its area. The portion of the bubble closer to the narrow d11 edge of the capillary is subjected to a higher capillary force than the portion nearer the wide d12 edge of the capillary. As a result of the varying capillary forces, the bubble 180 elongates, and moves toward the wide d12 edge of the capillary. Since the bubble is also subject to the forces of the moving fluid, the bubble moves in a diagonal manner towards the wide edge of the capillary and in the direction of fluid flow, as indicated by the white arrow.

So long as the bubble is of sufficient size to contact both of the capillary plates 110, 120, the bubble will continue to move in a diagonal manner towards the meniscus 171, as indicated by the bubble at 180'. Ultimately the bubble reaches the meniscus and is expelled from the fluid, as indicated at 180".

A smaller bubble, as depicted at 182 and 182', is not affected by the capillary gradient and is carried with fluid flow.

The present invention thus comprises providing a capillarity gradient within a fluid transport or containment structure to selectively capture and transport gas bubbles over a given size. Typically, the capillarity gradient is utilized to separate the bubbles from the bulk of the fluid and move them out of the fluid. The capillarity gradient may be a relatively simple structure, as depicted in FIG. 1, serving to move bubbles away from a critical area in a fluid delivery system, or it may be a more complex structure, as discussed below.

Although the capillarity gradient in FIG. 1 is achieved by changing the spacing between the two plates, the gradient may also be achieved in other ways, such as by providing surfaces having different hydrophilic properties, as discussed below. One exemplary use of the present invention is in ink delivery systems for printers; the materials utilized to form the capillary structures would thus be formed of a material that is impervious to ink and chemically non-reactive with ink.

Figure 2A:
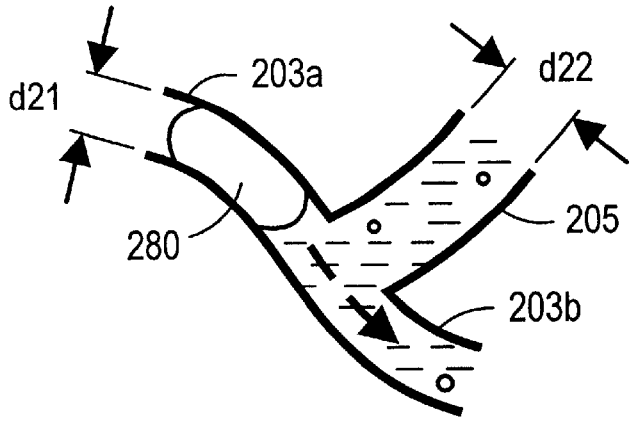
FIGS. 2(*a*) through 2(*c*) illustrate the concept of the present invention as implemented with discrete capillary elements.
Figure 2B:
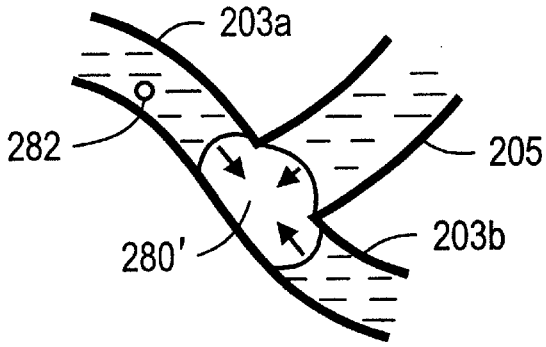
Figure 2C:
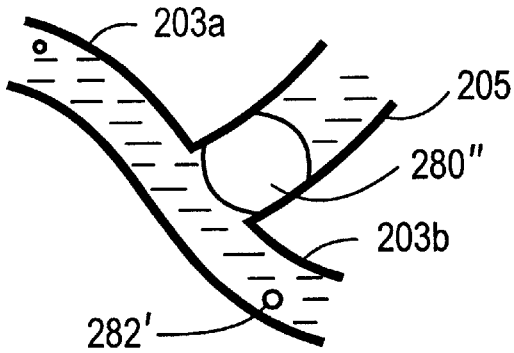

FIG. 2 provides an exemplary illustration of how capillary gradients may be formed with discrete capillary members having different capillarities. As shown in FIG. 2(*a*), a first capillary 203*a*/*b* having a diameter d21 meets a second capillary 205 having a larger diameter d22. Assuming that the many other factors contributing to the capillarity (such as surface properties) are the same, the larger diameter capillary has a lower capillarity than the narrow capillary. A gas bubble 280 is shown moving through capillary 203*a*/*b* with the fluid flow (indicated by the heavy dashed arrow).

At FIG. 2(*b*), the bubble 280' has moved along capillary 203*a*/*b* to a point of intersection with capillary 205. At this point, the bubble is subject to differing capillary forces, as indicated by the differing length arrows. The capillary forces exerted on the bubble from capillary 203*a*/*b* are greater than the capillary forces exerted on the bubble from capillary 205. As a result, the bubble is pushed from capillary 203*a*/*b* into capillary 205. The inertia effects of the fluid, as it moves in from both sides of the bubble, contribute to completing the transfer of the bubble to capillary 205 (too large of a size difference in the capillaries may hinder transfer of the bubble, and, in effect, create a bubble trap at the junction of the two capillaries). At FIG. 2(*c*), the bubble 280" has been pushed by capillary forces entirely out of capillary 203*a*/*b* into capillary 205.

Again, for capillary forces to act on a bubble, the bubble must be of sufficient volume to contact the capillary walls. A smaller bubble, such as shown at 282 and 282', is unaffected by the capillarity gradient and moves with the bulk of the fluid.

Although the capillarity gradient in FIG. 2 is achieved by varying the physical dimensions of the capillaries, the gradient could also be achieved by forming the capillaries of materials having differing hydroscopic properties. For example, capillaries 203 and 205 could have substantially the same widths, with capillary 203 being formed of a more hydrophilic material, or having a more hydrophilic surface treatment. Surface treatments may be include the local application of a surfactant, plasma treatment, grafting hydrophilic moieties onto the film surface, sol-gel coating, corona or flame treatment, etc. Alternatively, a surfactant or other suitable agent may be blended with the material of which the capillaries are formed.

Figure 3:
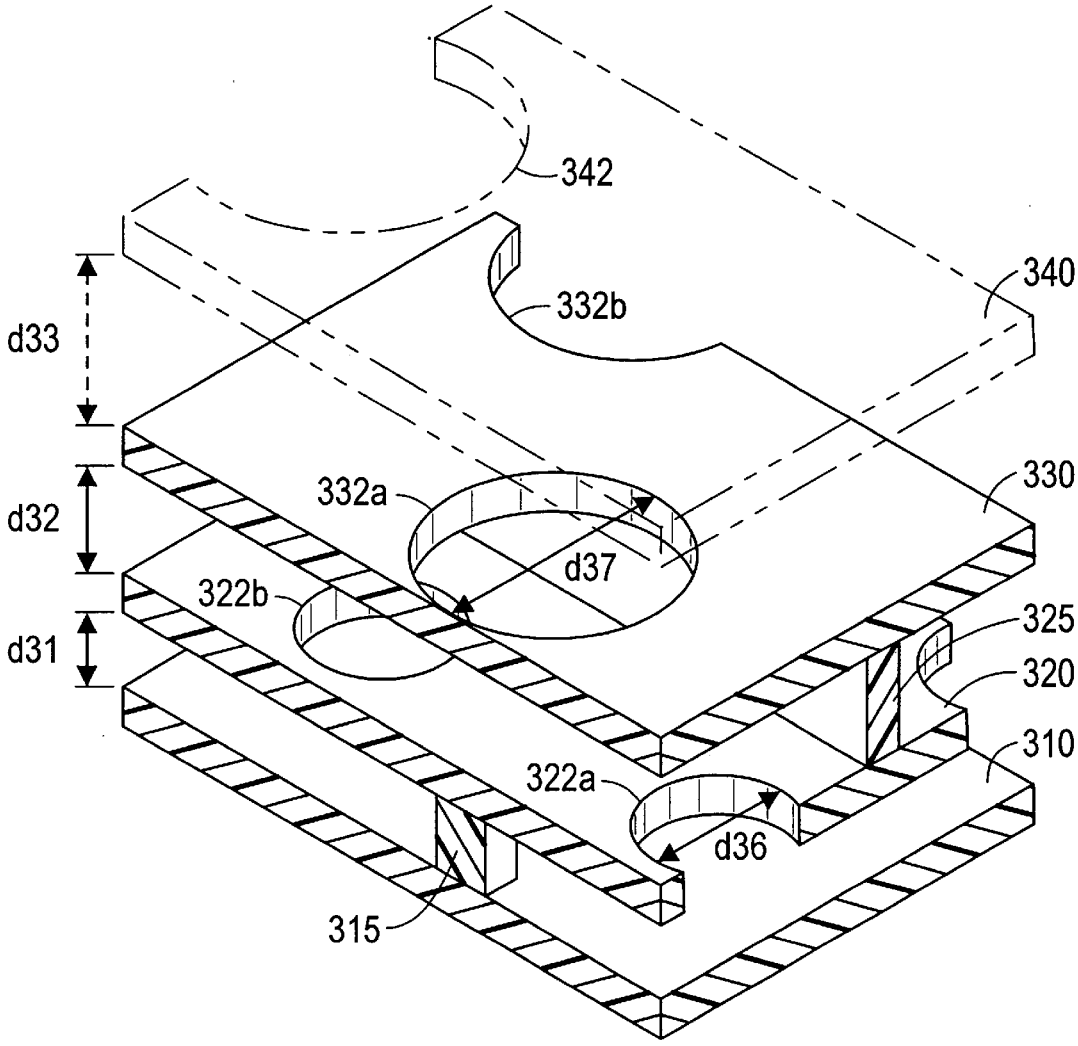
FIG. 3 is an isometric view of an embodiment of the present invention having multiple plate capillary structures fluidically connected with appropriately sized capillary through-holes.
Figure 4A:
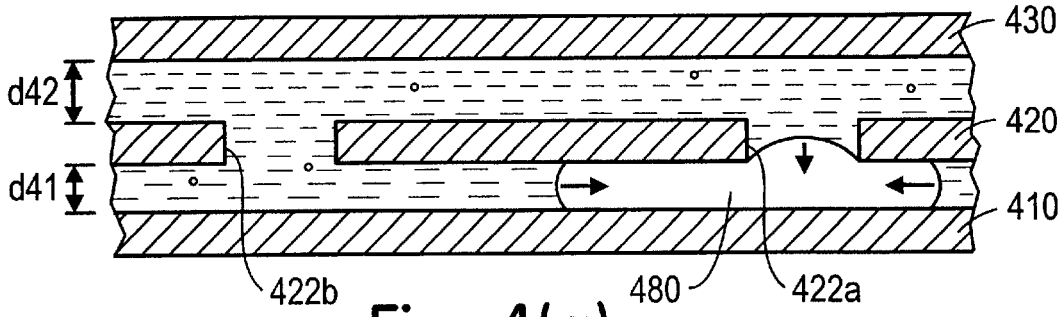
FIGS. 4(*a*) through 4(*d*) illustrate the movement of an air bubble within the embodiment of FIG. 3.
Figure 4B:
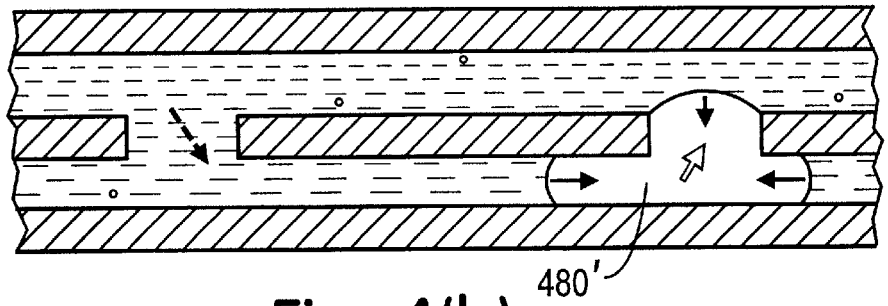
Figure 4C:
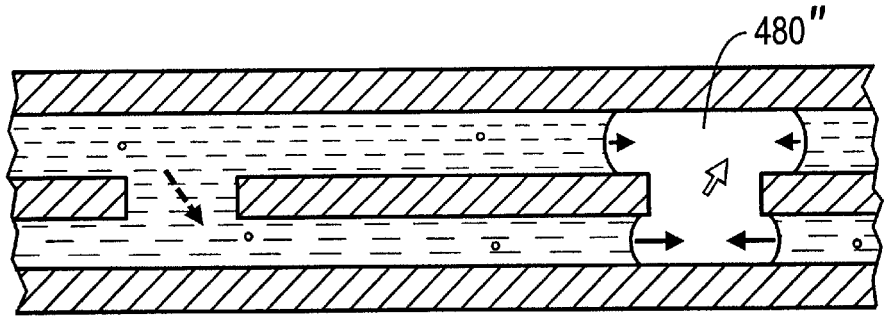
Figure 4D:
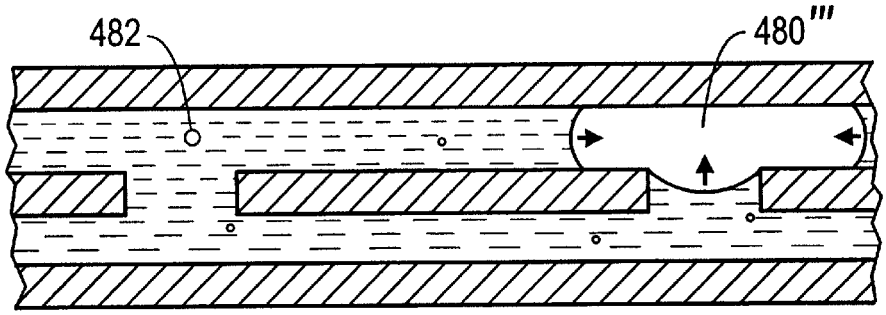

FIG. 3 illustrates an exemplary embodiment of the present invention in which multiple capillaries, formed between substantially flat plates, are used in conjunction with appropriately sized through-holes to selectively remove gas bubbles from a fluid. The flat capillary structures may form part of a fluid transport mechanism, which may be utilized for such purposes as delivery of ink from an ink reservoir to the printhead in a printer.

As shown in FIG. 3, multiple sheets of material 310, 320, 330 are separated by small distances d31, d32 to form plate capillary regions between the sheets. Spacers, comprising discrete "pillars", as at 315, or continuous walls, as at 325, maintain the fixed separation between the sheets. The spaces may be of any form that maintains the proper spacing of the sheets. The interior sheets 320, 330 are perforated with multiple through-holes 322*a*/*b*, 332*a*/*b*, allowing fluid passage between the sheets.

The present invention as applied to the embodiment of FIG. 3 entails sizing the through-holes between capillary sheet layers to create a capillarity gradient from one sheet capillary, through the through-hole, to the adjacent sheet capillary.

It has been observed that a round hole of diameter "D" has roughly the same capillarity as a sheet capillary of height D/2. Thus, to create a gradient of decreasing capillarity from the capillary sheet defined by sheets 310 and 320, through hole 322*a*, to the next capillary sheet defined by sheets 320 and 330, the diameter d36 of hole 322*a* is sized to be more than twice the plate separation d31, but less than twice the plate separation d32. Or, equivalently:

$$d31 < d36/2 < d32. \quad [1]$$

Similarly, if the capillary structure is extended to additional layers fluidically coupled with through-holes, such as denoted by the capillary layer formed by sheets 330 and 340 and through-hole 332*a*, the through-hole diameter is selected such that the capillarity of the hole is less than the capillarity of one layer, and more than the capillarity of the other layer (e.g.;

$$d32 < d37/2 < d33). \quad [2]$$

Other factors besides geometry affect the capillarity of the sheets and through-holes, including surface properties of the material. Proper sizing of the through-holes for a given material may be determined empirically.

The exemplary structure depicted in FIG. 3 may be extended to additional layers, or may be combined with other structures providing a capillarity gradient.

FIGS. 4(*a*) through 4(*d*) illustrate in further detail how, over an interval of time, a gas bubble in one sheet capillary member is first selectively attracted into a through-hole between capillary layers, and then selectively attracted into the sheet capillary member having the lower capillarity.

In FIG. 4(*a*), a gas bubble 480 is present in the sheet capillary formed between sheets 410 and 420 (the sheets and the capillaries formed by the sheets are shown in cross section). The bubble has moved within the capillary to where it is adjacent to a through-hole 422*a*. The through-hole provides fluid communication between the sheet capillary formed by sheets 410 and 420, and the sheet capillary formed by sheets 420 and 430. Sheets 410 and 420 are spaced apart by a distance d41, and sheets 420 and 430 are spaced apart by a greater distance d42. The capillary formed by sheets 410 and 420 thus has a greater capillarity than the capillary formed by sheets 420 and 430. The diameter of through-hole 422*a* is selected such that the capillarity of the hole is intermediate between that of the two sheet capillaries.

As indicated by the small arrows in FIG. 4(*a*), the force on bubble 480 due to the sheet capillary is greater than the force due to the through-hole. The bubble is thus forced from the sheet capillary into the through-hole, as shown in FIG. 4(*b*).

As shown in FIGS. 4(*c*) and 4(*d*), the bubble 480'/480" then becomes subjected to the even lower capillarity of the wider sheet capillary, and is thus forced from the narrower sheet capillary, through the through-hole, into the wider capillary.

Again, although the capillary gradient from the first capillary sheet to the through-hole and then to the second capillary sheet is illustrated in FIG. 4 as comprising physical capillary size differences, other methods of creating a capillary difference, such as the use of materials with differing hydrophobic or hydrophilic properties or different surface coatings, may be used in place of or in addition to capillary size differences. The capillaries may also be of other shapes rather than flat, so long as a capillarity gradient is established between the capillaries.

Figure 5:
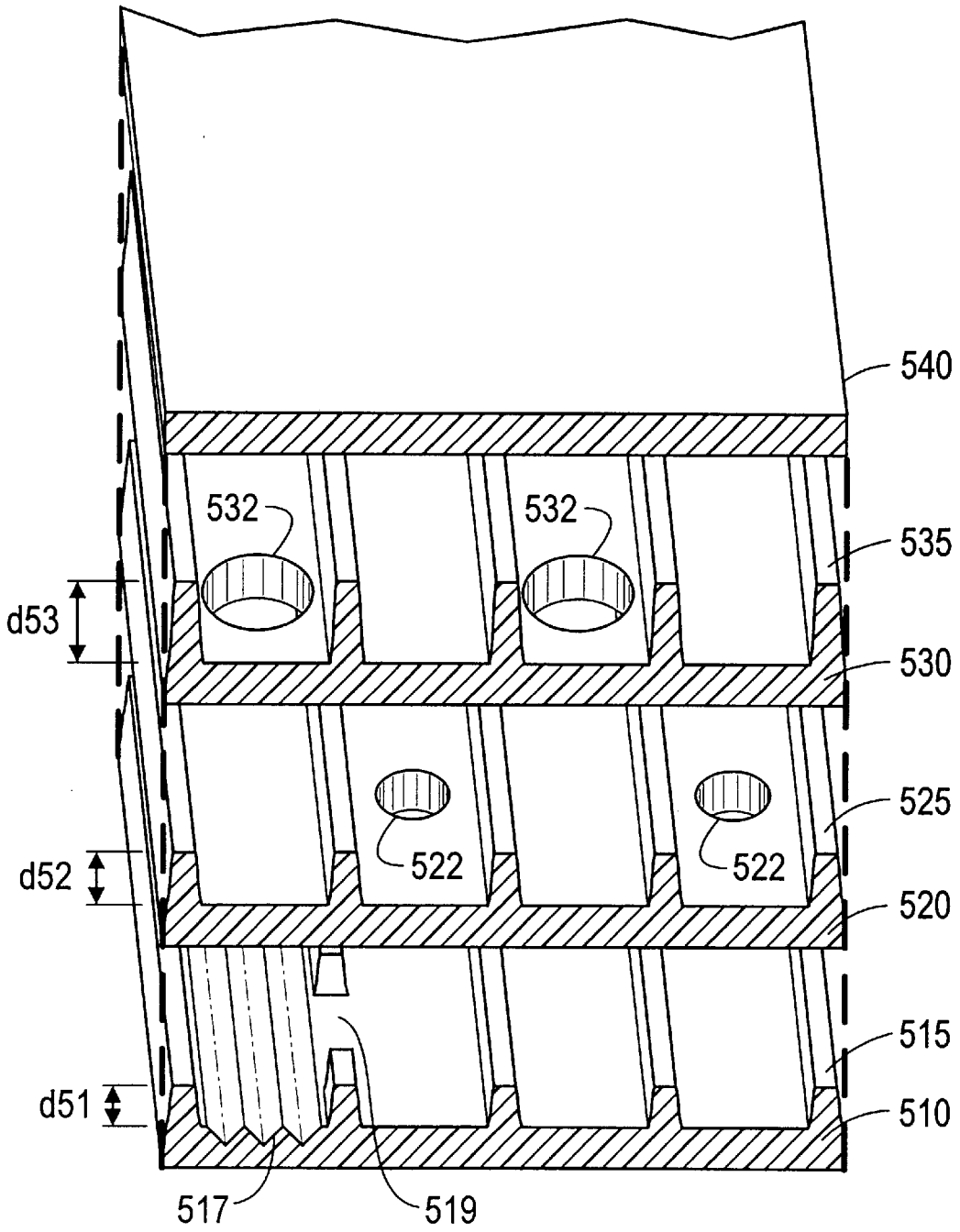
FIG. 5 is an exploded view of a further embodiment of the present invention formed of sheets of a capillary fluid transport material.

FIG. 5 illustrates one exemplary embodiment of a fluid transport device incorporating aspects of the present invention. The embodiment of FIG. 5 contemplates forming sheets of a fluid transport material with integral spacers and through-holes, and laminating the sheets together to form a fluid transport device. Three layers of fluid transport material 510, 520, 530 are shown in FIG. 5, with a flat cover layer 540. The concepts of the invention may equally be applied to more or fewer layers of material.

Each layer 510, 520, 530 of fluid transport material has integrally formed spacers 515, 525, 535, appropriately sized to create a capillarity gradient between the layers. d51 is thus less than d52, which is less than d53. Holes 522, 532 provide fluid communication between the layers. As discussed with respect to FIG. 3, the holes are sized to provide a capillarity intermediate between the capillarity of the adjoining sheets. Typical of materials suitable for forming the sheets are the liquid management films disclosed in U.S. Pat. No. 5,728,446 Johnston et al., LIQUID MANAGEMENT FILM FOR ABSORBENT ARTICLES.

Many variations of the exemplary embodiment of FIG. 5 are also possible. For example, the sheets of fluid transport material may include microstructures to improve the fluid transport characteristics, as shown at 517. The spacing members between the sheets may be continuous or non-continuous, as shown at 519.

Figure 6:
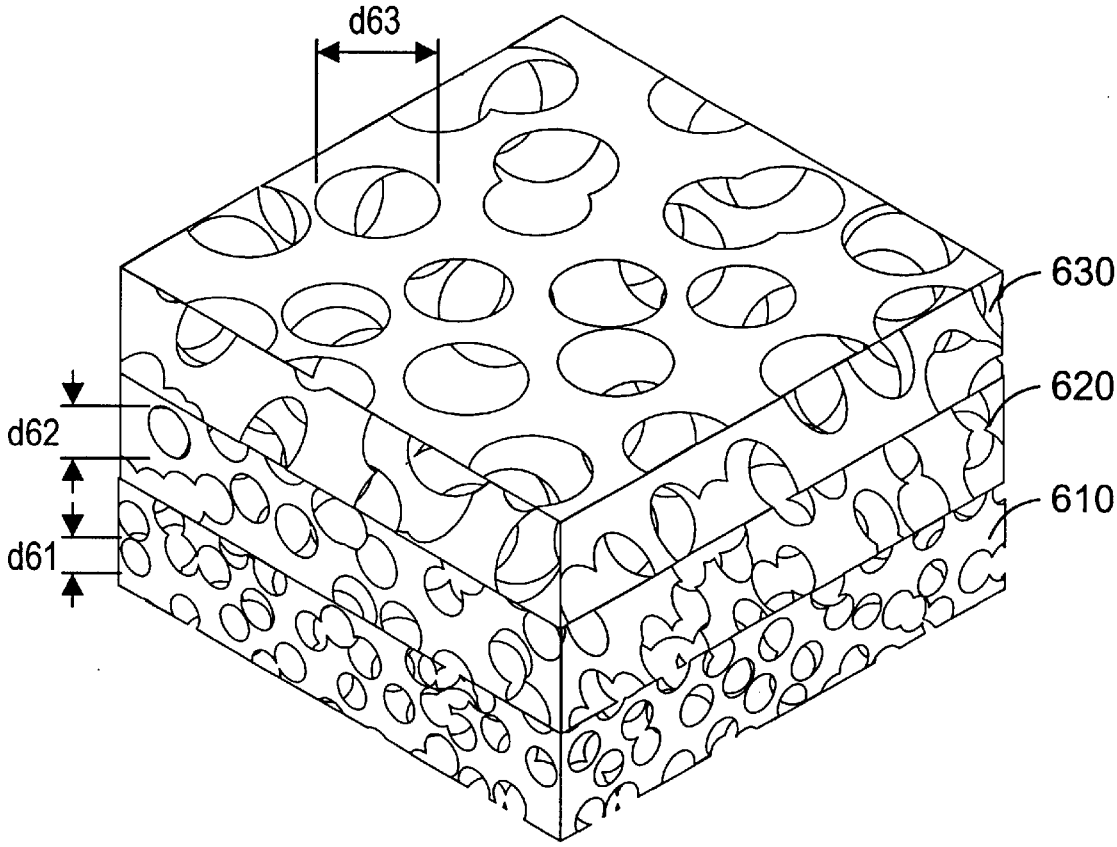
FIG. 6 is an isometric view of an embodiment of the invention utilizing thin layers of capillary foam having graded capillary sizes.

FIG. 6 shows a further embodiment of the present invention in which thin layers of porous foam may be combined to provide a capillary gradient. Three layers of foam 610, 620, 630 are shown in FIG. 6; the concept of the invention may be extended to more or fewer layers. Each foam layer has a characteristic capillary size, as denoted by d61, d62, and d63. The layers create a capillary gradient, serving to selectively move bubbles from the layers of higher capillarity to the layers of lower capillarity (e.g., from layer 610 to layer 620 to layer 630).

A Further Exemplary Embodiment

Figure 7:
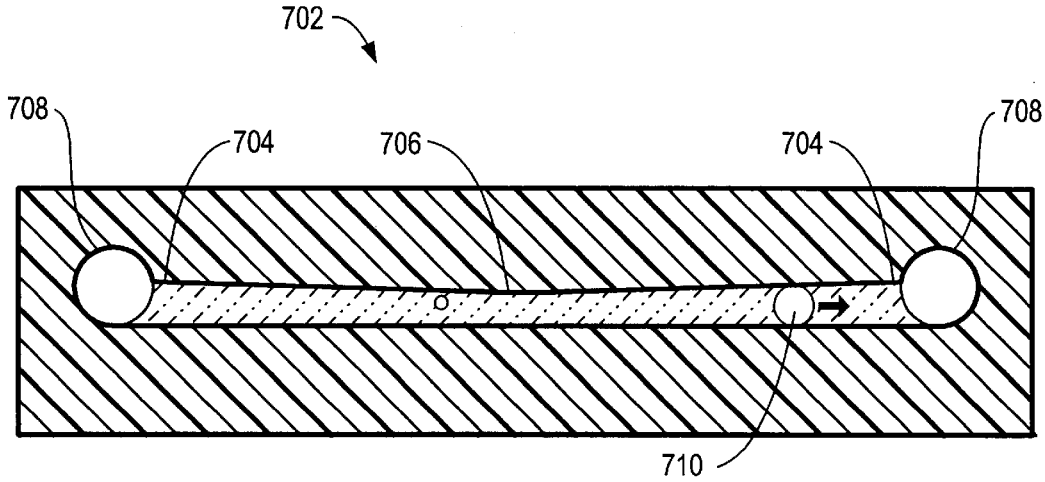
FIG. 7 is a cross-sectional view of an exemplary inkjet ink feed slot incorporating embodiments of the present invention.

One exemplary use for the capillary structures of the present invention is in removing air bubbles from the ink feed slot of inkjet printheads. FIG. 7 illustrates an exemplary embodiment of an ink feed slot 702 incorporating capillary structures according to the present invention.

A typical prior art inkjet ink slot may be formed using a "wet etch" process, as is known in the art. Typically such ink slots are sufficiently wide that they are not prone to capturing air bubbles. A wide ink slot, however, makes the inkjet die larger and more expensive. In addition to being less expensive to produce, a die with a narrow ink slot also enables additional ink delivery schemes, such as using capillary forces to move ink into and within the die, and using capillary forces to make the inkjet die "self priming".

The exemplary embodiment of FIG. 7 utilizes a tapered ink slot to move air out of the slot. The tapered slot may take various forms. The embodiment shown and described is substantially in the shape of a "dogbone". The shape of the ink slot when viewed from the back side is that of a dogbone, or hourglass. The walls of the slot get closer as you move from the ends 704 of the ink slot, to the center 706. In the example illustrated, the taper of the two walls is approximately 2 degrees. In addition, there is a larger knob 708 at each end of the slot. The enlarged ends, or knobs, of the slot work to vent the accumulated air to atmosphere. This achieves bubble management through passive air management.

The exemplary ink slot of FIG. 7 may be formed using a dry etch process or a wet/dry combination etch to create an ink slot. In the exemplary embodiment only the "upper" wall of the slot is angled, while the other, "lower" wall is straight. The inkjet ejection nozzles would be formed along the straight edge (not shown). The walls may be parallel in the z-axis (into the die.)

When a bubble 710 touches both walls, the differential capillary forces cause it to move to a wider space as the bubble grows. This means it will move to either end of the "dogbone" inkslot. When it reaches the end 704, it joins the air in the knob 708. Air (rather than ink) is present in the knob portion of the slot because the system backpressure is stronger than the capillary forces of the knob (the ink within a printhead is typically maintained at a "backpressure" relative to ambient air to prevent "drooling" of ink from the print nozzles). A bubble that is located at the narrow point is in an unstable situation and will move toward one end or the other.

Summary

Many other fields have air management issues similar to those in ink jet printing, and the present invention may be usefully applied those fields. For example, in fuel cells carbon dioxide may be produced as a reaction product, and the bubbles thus resulting must be efficiently removed from the system. The present invention may also be used to separate other fluids, such as bubbles of an immiscible oil-based fluid from an aqueous fluid.

The above is a detailed description of particular embodiments of the invention. It is recognized that departures from the disclosed embodiments may be within the scope of this invention and that obvious modifications will occur to a person skilled in the art. It is the intent of the applicant that the invention include alternative implementations known in the art that perform the same functions as those disclosed. This specification should not be construed to unduly narrow the full scope of protection to which the invention is entitled.

The corresponding structures, materials, acts, and equivalents of all means or step plus function elements in the claims below are intended to include any structure, material, or acts for performing the functions in combination with other claimed elements as specifically claimed.

What is claimed is:

1. A configuration of capillary structures for transporting fluid and providing passive management of gas, the configuration of capillary structures having a primary axis of capillary fluid transport with substantially constant capillary strength along the primary axis of fluid transport, and having decreasing capillary strength along an axis other than the primary direction of capillary fluid transport.

2. The configuration of capillary structures for fluid transport and passive management of gas of claim 1, wherein the capillary structure comprises a capillary formed between substantially flat surfaces separated by a narrow distance.

3. The configuration of capillary structures for fluid transport and passive management of gas of claim 2, wherein the decreasing capillary strength along an axis other than the primary axis of capillary fluid transport is provided by varying the distance separating the substantially flat surfaces along an axis orthogonal to the primary axis of fluid transport.

4. The configuration of capillary structures for fluid transport and passive management of gas of claim 2, wherein the flat surfaces have hydrophilic properties, and wherein the decreasing capillary strength along an axis other than the primary direction of capillary fluid flow transport is provided by varying the hydrophilic properties of the surfaces.

5. The configuration of capillary structures for fluid transport and passive management of gas of claim 1, further comprising:

a first capillary structure for fluid transport along the primary fluid transport axis, the first capillary element having a first capillary strength;

a second capillary structure intersecting the first capillary element and in fluidic communication with the first capillary element, the second capillary element having a second capillary strength; and wherein the second capillary strength is different than and less than the first capillary strength.

6. The configuration of capillary structures for fluid transport and passive management of gas of claim 5, wherein the different capillary strengths of the first and second capillary structures is provided by different capillary geometries.

7. The configuration of capillary structures for fluid transport and passive management of gas of claim 5, wherein the first and second capillary structures have capillary surfaces with hydrophilic properties, and the different capillary strengths are provided by varying the hydrophilic properties.

8. The configuration of capillary structures for fluid transport and passive management of gas of claim 1, further comprising:

a first capillary structure for capillary fluid transport in the primary direction of fluid transport, the first capillary structure formed between a plurality of substantially flat surfaces; and a second capillary structure in the form of a hole in one of the substantially flat surfaces, the hole in fluidic communication with the first capillary structure, the second capillary structure having a second capillary strength;

and wherein the second capillary strength is less than the first capillary strength.

9. The configuration of capillary structures for fluid transport and passive management of gas of claim 1, wherein the capillary structures are formed within a porous foam.

10. The configuration of capillary structures for fluid transport and passive management of gas of claim 9, wherein the decreasing capillary strength along an axis other than the primary direction of fluid transport is provided by layers of foam having differing capillary strengths.

11. The configuration of capillary structures for fluid transport and passive management of gas of claim 1, wherein the capillary structure is impervious to ink and chemically non-reactive with ink.

12. A configuration of capillary structures for fluid transport and passive management of gas, the structure comprising:

first capillary means for fluid transport along a primary axis, the first capillary means having substantially constant capillary strength along the primary axis; and, in fluidic communication with the first capillary means, second capillary means having decreasing capillary strength along an axis other than the primary axis.

13. A capillary action fluid transport apparatus, comprising:

first and second primary capillary structures configured to transport fluid by capillary action along a primary axis, the first and second primary capillary structures having different capillary strengths;

multiple secondary capillary structures fluidically coupling the first and second primary capillary structures and providing fluid flow a secondary axis, the secondary capillary structures having capillary strengths intermediate between the capillary of the first and second primary capillary structures.

14. The capillary action fluid transport apparatus of claim 13, wherein the first and second primary capillary structures are each formed between substantially flat surfaces.

15. The capillary action fluid transport apparatus of claim 14, wherein the substantially flat surfaces comprise hydrophilic fluid transport films.

16. The capillary action fluid transport apparatus of claim 15, wherein the multiple secondary capillary structures comprise through-holes formed in at least one of the hydrophilic fluid transport films.

17. The capillary action fluid transport apparatus of claim 13, wherein the primary and secondary capillary structures are impervious to ink and chemically non-reactive with ink.

18. A component for a fluid management system, comprising:

A plurality of layers of fluid transport film laminated together such that capillary spaces are formed between each adjoining pair of layers, each capillary space have a capillary strength;

for each layer of fluid transport film lying between two capillary spaces, multiple through-holes providing fluidic communication between the capillary spaces, the through-holes having a capillary strength;

each two capillary spaces separated by a layer of fluid transport film having different capillary strengths; and the capillary strength of the through-holes intermediate between the capillary strengths of capillary spaces.

19. The component for a fluid management system of claim 18, wherein the different capillary strengths of the capillary spaces are provided by different capillary geometries.

20. The component for a fluid management system of claim 18, wherein each of the layers of fluid transport film has hydrophilic properties, and wherein the different capillary strengths of the capillary spaces are provided by varying the hydrophilic properties of the layers.

21. The capillary action fluid transport apparatus of claim 18, wherein the layers of fluid transport film are impervious to ink and chemically non-reactive with ink.

22. A capillary structure for fluid transport and management of immiscible fluids, the structure having a primary axis of capillary fluid transport with substantially constant capillary strength along the primary axis of fluid transport, and having decreasing capillary strength along a axis other than the primary axis of capillary fluid transport.

23. A method of managing gas bubbles in a capillary fluid transport mechanism, comprising:

positioning along the capillary and in fluid communication with the capillary a second capillary leading substantially away from the first capillary, the second capillary having a lower capillary strength than the first capillary.

24. The method of claim 23, wherein the first capillary path is formed between narrowly spaced sheets of hydrophilic material, the sheets having thicknesses, and the second capillary path comprises a hole through one of the sheets.

25. The method of claim 24, wherein spacing between the narrowly-spaced sheets is maintained by spacing members integrally formed with the sheets.

26. An arrangement of capillaries for fluid transport and passive gas management, the capillaries having differing capillary affinities, the capillaries arranged to selectively capture and transport gas bubbles over a given size.

27. An ink feed slot for an inkjet printhead, the slot formed between a first wall and a second wall, the ink feed slot having a center portion and two end portions, the first and second walls in the center portion spaced close together such that air bubbles may be captured by capillary action between the walls, the walls tapering apart towards the two end portions, such that air bubbles are moved from the center portion to the end portions.

28. The ink feed slot of claim 27, further comprising enlarged knob portions adjacent to the side portions, the enlarged knob portions configured to transport air away from the feed slot.

29. The ink feed slot of claim 28, wherein the ink within the printhead is maintained at a backpressure, and wherein the enlarged knob portions are sized such that capillary affinity of the end portions is less than the ink backpressure.

* * * * *

UNITED STATES PATENT AND TRADEMARK OFFICE

CERTIFICATE OF CORRECTION

PATENT NO. : 6,682,186 B2
DATED : January 27, 2004
INVENTOR(S) : Smith et al.

It is certified that error appears in the above-identified patent and that said Letters Patent is hereby corrected as shown below:

Column 10,
Line 50, delete “a” and insert in lieu thereof -- an --.

Signed and Sealed this

Seventeenth Day of August, 2004

JON W. DUDAS
*Acting Director of the United States Patent and Trademark Office*